US006182568B1

(12) United States Patent
Ogita et al.

(10) Patent No.: US 6,182,568 B1
(45) Date of Patent: Feb. 6, 2001

(54) PRINTING BLANKET

(75) Inventors: Toshikazu Ogita, Miki; Seiji Tomono; Hiromasa Okubo, both of Kobe; Takamichi Sagawa, Akashi, all of (JP)

(73) Assignee: Sumitomo Rubber Industries, Ltd., Hyogo (JP)

( * ) Notice: Under 35 U.S.C. 154(b), the term of this patent shall be extended for 0 days.

(21) Appl. No.: 09/172,032

(22) Filed: Oct. 14, 1998

(30) Foreign Application Priority Data

Nov. 14, 1997 (JP) ..... 9-313951

(51) Int. Cl.[7] ..... B41N 10/04
(52) U.S. Cl. ..... 101/376; 428/909
(58) Field of Search ..... 101/217, 375, 101/376, 492, 493; 428/909

(56) References Cited

U.S. PATENT DOCUMENTS

| | | | | |
|---|---|---|---|---|
| 3,652,376 | * | 3/1972 | Bowden, III | 428/909 |
| 4,388,363 | * | 6/1983 | Fountain | 428/909 |
| 5,347,927 | * | 9/1994 | Berna et al. | 101/375 |
| 5,350,623 | * | 9/1994 | Derrick | 101/217 |
| 5,352,507 | * | 10/1994 | Bresson et al. | 428/909 |
| 5,431,989 | * | 7/1995 | Beltzung et al. | 428/909 |
| 5,832,824 | * | 11/1998 | Okubo et al. | 101/217 |
| 5,934,192 | * | 8/1999 | Ogita et al. | 101/376 |

FOREIGN PATENT DOCUMENTS

| | | | | |
|---|---|---|---|---|
| 1940852 | * | 2/1970 | (DE) | 428/909 |
| 2244765 | * | 3/1974 | (DE) | 428/909 |
| 154809 | * | 11/1981 | (JP) | 428/909 |
| 18356 | * | 4/1987 | (JP) | 428/909 |
| 5-301483 | | 11/1993 | (JP) . | |
| 6-270573 | | 9/1994 | (JP) . | |

* cited by examiner

*Primary Examiner*—Stephen R. Funk
(74) *Attorney, Agent, or Firm*—Birch, Stewart, Kolasch & Birch, LLP

(57) ABSTRACT

The present invention provides a printing blanket which includes a first compressive layer which is porous and seamless, a non-expansion layer formed by spirally winding a wire in a circumferential direction of the blanket so that a distance between adjacent wires is not more than 0.5 mm, a second compressive layer which is porous and seamless, a surface printing layer which is seamless and non-compressive, and a cylindrical sleeve to be fit over a blanket cylinder, wherein these layers are laminated in this order on the outer peripheral surface of this cylindrical sleeve directly or through a seamless adhesive layer. According to this printing blanket, piling caused at the time of high-speed printing is inhibited and printing can be performed in high productivity.

6 Claims, 6 Drawing Sheets

PRINTING BLANKET

BACKGROUND OF THE INVENTION

The present invention relates to a seamless cylindrical printing blanket, which is suitably used in a high-speed web offset printing press.

A printing blanket of the prior art was in the form of a plate, and was used by winding around a blanket cylinder of a printing press. With this construction, however, there arose a problem that a seam portion is formed in a printing blanket and a pressing force of a plate cylinder varies whenever the seam portion passes through a nip portion between the blanket cylinder and the plate cylinder to cause vibration and shock load, resulting in deterioration of the printing quality. Particularly, deterioration of the printing quality was remarkable at the time of high-speed printing where the blanket cylinder rotates at high speed of not less than 1,100 rpm.

Therefore, a cylindrical printing blanket having no seam in a circumferential direction has recently been suggested as a printing blanket suited for high-speed printing using a web offset printing press and the like. As shown in FIG. 4, such a cylindrical printing blanket 20 comprises a compressive layer 22, which is porous and seamless, a non-expansion layer 23 and a seamless surface printing layer 25 and a cylindrical sleeve 11 to be fit over a blanket cylinder, the layers 22, 23 and 25 being laminated in this order on the outer peripheral surface of the cylindrical sleeve 11 through seamless adhesive layers g1, g2, g3 (see Japanese Patent Laid-Open Publication No. 5-301483), respectively.

Among the above layers, the surface printing layer is made of a volume-non-compressive (that is, non-compressive as a change in volume does not arise even if plastic deformation is applied) elastomer and absorbs ink (not shown) from a printing plate 42 at a nip portion 41 formed between a printing blanket 20 and a plate cylinder 40 (see FIG. 5).

The compressive layer 22 is formed by applying a coating solution containing an elastomer such as rubber, drying the solution and optionally curing (or vulcanizing) in a case where the rubber is employed as the elastomer. The compressive layer 22 is volume-compressive because of its porous structure (that is, the volume is reduced by compression) and, therefore, the vibration absorbing property and pressure absorbing property are imparted to the whole printing blanket 20, thereby to inhibit bulging in the neighborhood of the nip portion 41 and to prevent deformation of an image such as slur and double in the printing direction (i.e. circumferential direction x of blanket) of the blanket 20.

At the time of high-speed printing; however, there arises a problem that a shear deformation is applied to the blanket 20 at the nip portion 41 and, therefore, the image is deformed in the circumferential direction x of the blanket to cause slur and double.

Therefore, for the purpose of inhibiting slur and double, the non-expansion layer 23 is provided on the compressive layer 22. This non-expansion layer 23 is formed by spirally winding a wire 17 such as a thread in the circumferential direction x of the blanket with applying a tension. By providing such a non-expansion layer 23, the shear deformation at the nip portion 41 of the blanket 20 can be reduced and the deformation of the printed image in the circumferential direction x of the blanket can be inhibited.

However, there is a limit in effect of inhibiting the above shear deformation by providing the non-expansion layer 23.

For example, in a high-speed printing at not less than 1,100 rpm, when the thickness of a surface printing layer 250 to be provided on the top of the non-expansion layer 23 becomes larger as shown in FIG. 6, it becomes impossible to obtain sufficient pressure absorbing effect due to the compressive layer 22 because the layer 250 is volume-non-compressive and the distance from the surface of the blanket 200 to the compressive layer 22 (i.e. thickness of blanket 200) becomes larger. As a result, when the plate cylinder 40 is pressed onto the blanket 200, bulging 43 (bulge deformation) is formed on the surface printing layer 250.

When the bulge deformation becomes larger, the nip width also becomes larger. Therefore, the solid inking property is improved but the halftone dot becomes thick due to dot gain, resulting in deterioration of the printing reproducibility. When the thickness of the surface printing layer 250 becomes larger, it becomes impossible to obtain the effect of inhibiting the shear deformation of the blanket 200 by the non-expansion layer 23. As a result, remarkable slur and double make it impossible to put to practical use.

On the other hand, when the surface printing layer 25 is thin as shown in FIG. 5, the shear deformation hardly arises and the reproducibility of the shape of the halftone dot is improved. However, since the non-expansion layer 23 is formed by winding a wire with applying a tension thereon, it contacts closely with the peripheral shape of the printing plate 42 and is not deformed and, therefore, the nip width 41 becomes smaller. At the time of high-speed printing at not less than 1,100 rpm, the time of contact between the printing plate 42 and blanket 20 becomes considerably short and transfer-of ink becomes insufficient, resulting in deterioration of the inking property of ink.

In such way, when the thickness of the surface printing layer is decreased, the halftone dot reproducibility is good and problems such as slur and double do not arise but the inking property of ink is deteriorated. On the other hand, when the thickness of the surface printing layer is increased, bulging arises and the nip width increases and, therefore, the inking property is improved but the dot gain arises to deteriorate halftone dot reproducibility. Besides, when the thickness of the surface printing layer is further increased, slur and bulging arise.

Accordingly, in order to practically satisfy both of the inking property of ink and halftone dot reproducibility, it is necessary to strictly adjust the thickness of the surface printing layer (specifically, the thickness of the surface printing layer is limited to about 0.4 mm to satisfy both the inking property and halftone dot reproducibility) and a scatter in quality of the product is liable to arise. At the time of high-speed printing at not less than 1,100 rpm, it becomes further difficult to satisfy both the inking property and halftone dot reproducibility since it is required to further reduce the thickness of the surface printing layer.

On the other hand, as shown in FIG. 7, in a case where a printing blanket 30 is provided with a compressive layer 32 only between a non-expansion layer 33 and a surface printing layer 35, since it is necessary to absorb the whole pressure only by the compressive layer 32, the thickness of the layers on the surface of the non-expansion layer 33 must be increased. In this case, the adhesion between the printing plate and the surface of the blanket 30 is improved and the solid inking property is improved. On the other hand, dot gain, slur and double do not arise at low-speed printing, however, the shear deformation arises in the circumferential direction of the blanket at high-speed printing at not less than 1,100 rpm because the thickness of the surface layers is larger than that of the non-expansion layer. Therefore, slur and double arise.

On the other hand, regarding a printing blanket disclosed in Japanese Patent Laid-Open Publication No. 6-270573, a surface printing layer is porous and fine pores are provided on the surface thereof for the purpose of inhibiting bulging. However, the above fine pores are generally formed by the extraction method using a water-soluble powder material such as salt and by the foaming method using micro-balloons, and it is difficult to obtain ultra-fine cells (pores) having a diameter of not more than 10 $\mu$m. Therefore, a lot of circular depressions having a diameter of not less than about 10 $\mu$m are formed on the surface of the blanket and the surface becomes rough so that the shape of the halftone dot is deteriorated, resulting in deterioration of the printing quality.

The surface area of the blanket surface becomes enlarged as a result of providing the porous surface printing layer and so-called piling, wherein ink and paper powder are accumulated on the blanket, is liable to arise. Consequently, the inking property of ink is liable to be deteriorated. Furthermore, when the degree of piling becomes severe, the number of washings of the blanket increases and the productivity of printing is deteriorated and, at the same time, paper loss at the time of washing increases. Accordingly, while there can be obtained such an advantage that the productivity of printing is enhanced by performing high-speed printing using a seamless blanket, there arises a problem that the productivity is deteriorated by an increase in number of washings and that undesirably high printing cost.

With the increase of the number of washings, wear of the blanket surface caused by a paper or a nonwoven fabric in blanket washing device and also scratches on the blanket surface caused by trouble over paper winding are increased. Accordingly, there arises another problem that the durability of the blanket becomes inferior.

SUMMARY OF THE INVENTION

It is an object of the present invention to provide a novel printing blanket which does not cause bulging in the printing blanket at the time of high-speed printing using a web offset printing press, can print a high-quality image with a proper nip width and can print with high productivity.

The present inventors have intensively studied to attain the above object to find out that when the following layers:

(1) a first compressive layer which is porous and seamless, (2) a non-expansion layer formed by spirally winding a thread in a circumferential direction of the blanket so that a distance between adjacent threads is not more than 0.5 mm;

(3) a second compressive layer which is porous and seamless, and (4) a surface printing layer which is seamless and non-compressive, are laminated in this order on the outer peripheral surface of a cylindrical sleeve to be fit over a blanket cylinder directly or through a seamless adhesive layer, a novel printing blanket wherein bulging does not arise even at the time of high-speed printing at 1,100 rpm or more; a high-quality image can be formed with a proper nip width; piling is inhibited; and printing is carried out with high productivity can be obtained. Thus, the present invention has been completed.

That is, the present invention provides:

1) A printing blanket comprising:
   (1) a first compressive layer which is porous and seamless,
   (2) a non-expansion layer formed by spirally winding a wire in a circumferential direction of the blanket so that a distance between adjacent wires is not more than 0.5 mm,
   (3) a second compressive layer which is porous and seamless,
   (4) a surface printing layer which is seamless and non-compressive, and
   a cylindrical sleeve to be fit over a blanket cylinder,
   wherein said the layers are laminated in this order on the outer peripheral surface of said cylindrical sleeve directly or through a seamless adhesive layer;

2) The printing blanket according to the above item (1), wherein the thickness of the second compressive layer is from 0.05 to 0.45 mm, the thickness of the surface printing layer is from 0.05 to 0.45 mm, the total of the thickness of the surface printing layer and that of the second compressive layer is from 0.1 to 0.5 mm, and the thickness of the first compressive layer is from 0.1 to 2.0 mm;

3) The printing blanket according to the above item (1) or (2), wherein the porosity of the second compressive layer is from 10 to 80%;

4) The printing blanket according to any one of the above items (1) to (3), wherein the porosity of the second compressive layer is higher than that of the first compressive layer; and 5) The printing blanket according to any one of the above items (1) to (4), wherein a base layer, which is seamless and non-compressive, is provided between the sleeve and the first compressive layer directly or through a seamless adhesive layer.

According to the printing blanket of the present invention, since two compressive layers are provided inside (sleeve side of) a surface printing layer through a non-expansion layer, a pressing force of a plate cylinder is absorbed by a first compressive layer provided inside (sleeve side of) the non-expansion layer and adhesion between the surface of the blanket and the plate cylinder can be improved by a second compressive layer provided outside (surface printing layer side of) the non-expansion layer.

The second compressive layer preferably makes the adhesion between the surface of the blanket and plate cylinder better. Accordingly, in comparison with the case where the compressive layer is provided only between the non-expansion layer and surface printing layer, the thickness of the compressive layer may be thin. As a result, it is also possible to decrease the thickness of the layers outside the non-expansion layer; an influence of the shear deformation is hardly exerted even at the time of high-speed printing at not less than 1,100 rpm; and slur and double do not arise.

Since the compressive layer has volume compressibility, dot gain, slur and double are sufficiently inhibited similar to the case where the surface printing layer is thin in a blanket of the prior art.

Consequently, according to the printing blanket of the present invention, dot gain, slur and double do not arise even at the time of high-speed printing at not less than 1,100 rpm; good halftone dot reproducibility is obtained and, at the same time, excellent solid inking property can be obtained. That is, it is possible to satisfy both the halftone dot reproducibility and solid inking property.

Furthermore, since the surface printing layer is non-compressive and does not have pores as described in Japanese Patent Laid-Open Publication No. 6-270573, the shape of the halftone dot is not deteriorated and piling hardly arises. Accordingly, wear and scratch of the surface are inhibited and the durability is not deteriorated.

Denotations of the reference symbols are as follows:

10: Printing blanket,

11: Sleeve,

12: First compressive layer,

13: Non-expansion layer,

14: Second compressive layer,

15: Surface printing layer,

16: Base layer,

17: Wire or thread,

100: Printing blanket, g1: Adhesive layer, g2: Adhesive layer, g3: Adhesive layer, x: Circumferential direction, and w: Distance between wires.

DISCLOSURE OF THE INVENTION

The printing blanket of the present invention will be described in detail with reference to FIG. 1 and FIG. 2, which respectively show its one embodiment.

Figure 1:
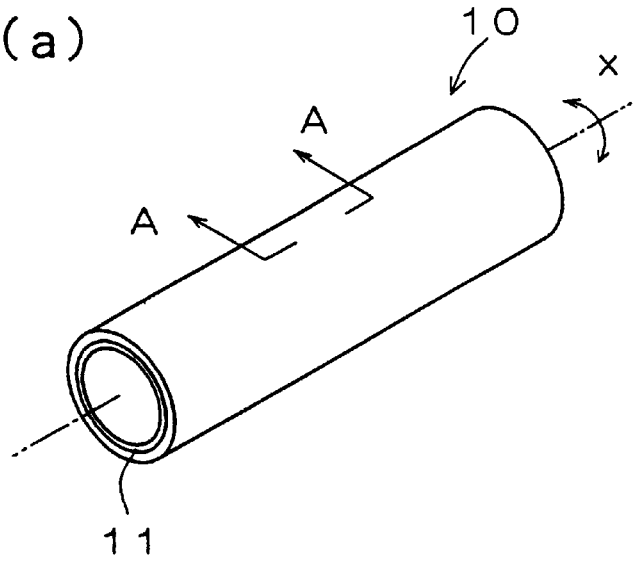
FIG. 1(*a*) is a perspective view showing one embodiment of a printing blanket of the present invention and FIG. 1(*b*) is a sectional view taken along lines A—A of FIG. 1(*a*)
Figure 1:
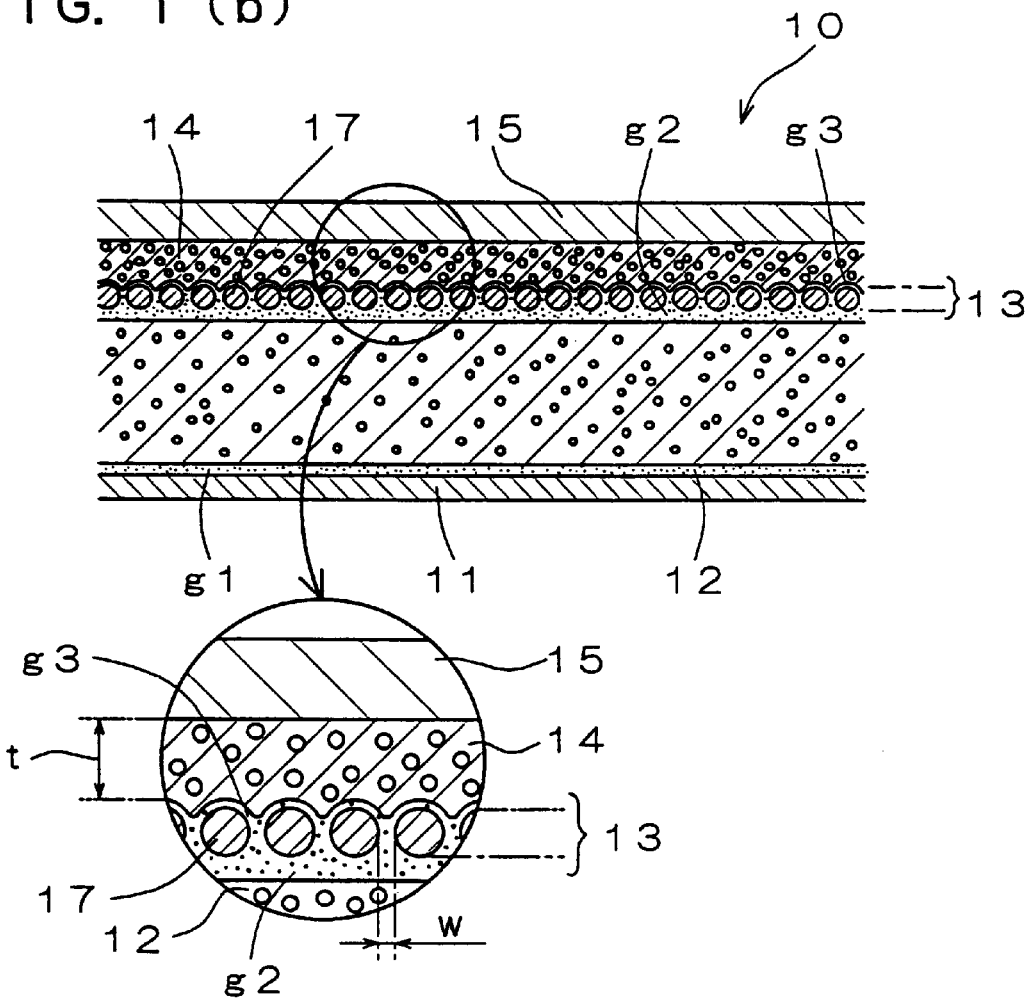
Figure 2:
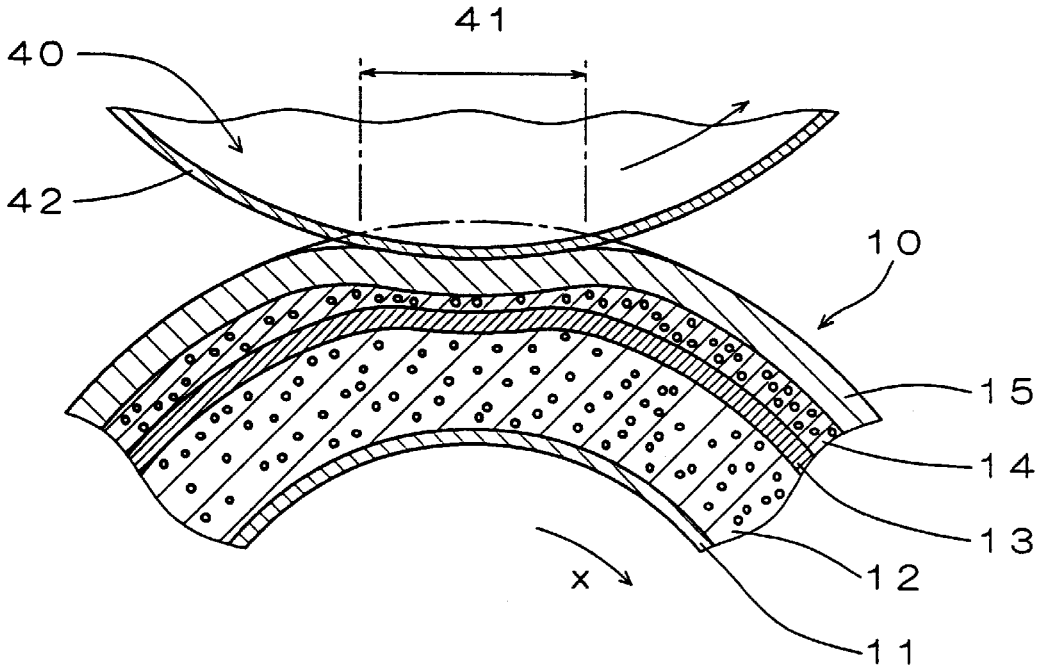
FIG. 2 is a sectional view showing a state of a nip portion when using a printing blanket of the present invention.

A printing blanket 10 of the present invention is provided with, as shown in FIG. 1(*b*), (1) a first compressive layer 12, which is porous and seamless, formed on the outer peripheral surface of a cylindrical sleeve 11 through an adhesive layer g1; (2) a non-expansion layer 13 formed on the surface of the above compressive layer 12 through an adhesive layer g2 by spirally winding a wire or thread 17 in a circumferential direction of the blanket 10 so that a distance w between adjacent wires or threads 17 is not more than 0.5 mm; (3) a second compressive layer 14, which is porous and seamless, on the surface of the above non-expansion layer 13 through an adhesive layer g3; and further (4) a surface printing layer 15, which is seamless and non-compressive, formed on the surface of the above second compressive layer 14.

(i) Sleeve 11

As the sleeve 11, there can be used any sleeves which have hitherto been known to public, such as a sleeve made of a very thin metallic material, sleeve made of a glass fiber-reinforced plastic and the like. Particularly, a sleeve made of nickel having a thickness of about 0.1 to 0.2 mm can be preferably used taking the rigidity, strength and modulus into consideration.

(ii) First Compressive Layer 12

The first compressive layer 12 is a layer made of an elastomer, which is porous and seamless, and is formed on the surface of a cylindrical sleeve 11 directly or through an adhesive layer g1. That is, the first compressive layer 12 is formed by applying an uncured rubber cement for said layer 12 on the surface of the sleeve 11 or on adhesive layer g1, or by winding a sheet made of an uncured compound for compressive layer 12 around the sleeve 11 or around adhesive layer g1, followed by curing. Regarding the above sheet, the seam portions are molten and integrated in curing, thereby to form a seamless state.

As the elastomer constituting the first compressive layer 12, there can be used a synthetic rubber having excellent effect of absorbing vibration and shock load and of high damping property to vibration, particularly preferably. The synthetic rubber is preferably superior in oil resistance taking the resistance to printing ink into consideration. Specific examples of the synthetic rubber include acrylonitrile-butadiene copolymer rubber (NBR), chloroprene rubber (CR), urethane rubber (U) and the like, but are not limited thereto.

The thickness of the first compressive layer 12 is set within the range from 0.1 to 2.0 mm, preferably from 0.2 to 1.0 mm, and more preferably from 0.3 to 0.7 mm, when the porosity satisfies the range described hereinafter. When the thickness of the first compressive layer exceeds the above range, the reaction force at the time of compression is lowered and the inking property of ink is deteriorated. On the other hand, when the thickness is smaller than the above range, the halftone dot is liable to be deformed and the printing quality is liable to be lowered.

The porous structure of the first compressive layer 12 may be either of a closed-cell structure wherein cells in said layer 12 are respectively closed or an open-cell structure wherein cells are open from the inside to the surface of the compressive layer.

The porosity showing the proportion of the cells (pores) in the first compressive layer 12 is not specifically limited; however, in the closed-cell structure, the porosity is within the range from 10 to 80%, preferably from 15 to 70%, and more preferably from 20 to 50%. On the other hand, in the open-cell structure, the porosity is within the range from 10 to 70%, preferably from 15 to 60%, and more preferably from 20 to 50%. When the porosity of the first compressive layer 12 is smaller than the above range, the effect of inhibiting bulging and expansion of the surface printing layer 15 in the circumferential direction x associated with bulging become insufficient and deformation of the halftone dot (e.g. double, slur, etc.) is liable to arise. On the other hand, when the porosity exceeds the above range, the reaction force at the time of compression is lowered and the halftone dot reproducibility and solid inking property are liable to be deteriorated.

To impart the closed-cell structure to the first compressive layer 12, foaming agents or hollow fine particles are contained in the above uncured rubber cement or compound. When using the foaming agent, the foaming agent is decomposed by heat at the time of curing to evolve a gas, thereby forming closed-cells. The hollow fine particles themselves form closed-cells.

As the foaming agent, there can be used any one which has hitherto been known as a foaming agent for rubber. Specific examples thereof include azodicarbonamide, N,N'-dinitrosopentamethylenetetramine, p,p'-oxybisbenzenesulfonylhydrizide and the like, but are not limited thereto. Examples of the hollow fine particles include those obtained by encapsulating a gas such as air into a closed shell body made of a thermoplastic resin, a thermosetting resin (e.g. phenol resin, etc.) or an inorganic material (e.g. glass, etc.). Among them, those obtained by forming the shell body from a flexible thermoplastic resin are preferable to maintain the flexibility of the first compressive layer 12. Examples of the hollow fine particles with the shell body made of the thermoplastic resin include EXPANCEL series manufactured by EXPANCEL CO., wherein the shell body is formed of a copolymer of vinylidene chloride and acrylonitrile, but are not specifically limited thereto.

To impart the open-cell structure to the first compressive layer 12, a so-called leaching method wherein particles, which can be extracted with a solvent exerting no influence on the characteristics of the rubber, is contained in the above uncured rubber cement or compound and then the mixture is cured to extract the particles may be used. According to this leaching method, cells (pores) opened to the surface are formed as a result of a trace where the particles were extracted, thereby constituting the open cell.

As the solvent for extraction in case of forming the open cell by using the above leaching method, water is preferably used in view of the safety and cost. Examples of the particles, which can be extracted with water, include particles of various water-soluble organic and inorganic materials such as sodium chloride, starch, sugar, polyvinyl alcohol, gelatin, urea, cellulose, sodium sulfate, potassium chloride and the like.

The amount of the above foaming agent, particle diameter and amount of the hollow fine particles, and particle diameter and amount of particles in the leaching method are appropriately decided according to the porosity of the above first compressive layer 12.

(iii) Adhesive Layer g1

The adhesive layer g1, which may be optionally provided between the sleeve 11 and the first compressive layer 12, is formed, for example, by applying a rubber cement for adhesive layer g1 on the sleeve 11.

As the rubber cement for adhesive layer g1, a curing adhesive is preferably used. When the sleeve 11 is made of a metal, an adhesive having excellent adhesion to both the metal and the rubber constituting the first compressive layer 12 is preferably used. The adhesive layer g1 may be an adhesive layer having a two-layer structure obtained by applying an adhesive having excellent adhesion to the metal on the surface of the sleeve 11 using a doctor blade or a doctor roll followed by drying, and then in the same manner, applying thereon an adhesive having excellent adhesion to the rubber constituting the first compressive layer 12, followed by drying.

The above adhesive having excellent adhesion to the metal is not specifically limited, but examples thereof include "Chemlock 205" (trade name) manufactured by LORD CHEMICAL CO. When the first compressive layer 12 is made of a NBR rubber, "Chemlock 252X" manufactured by the same company can be used as the latter adhesive. These adhesives are uncured synthetic rubbers, and are cured simultaneously when the first compressive layer 12 is cured, thereby bonding the sleeve 11 to the first compressive layer 12.

The thickness of the adhesive layer g1 is not specifically limited, but is within the range from 0.01 to 0.1 mm, preferably from 0.02 to 0.07 mm, and more preferably from 0.03 to 0.05 mm. When the thickness of the adhesive layer g1 is smaller than the above range, the adhesive force is liable to become insufficient. On the other hand, when the thickness exceeds the above range, it is liable to exert a harmful influence on the characteristics of the blanket. When the adhesive layer g1 has the two-layer structure as described above, the total of the thickness of two layers may be within the above range.

Non-expansion Layer 13

The non-expansion layer 13 is formed on the surface of the above compressive layer 12 directly or through an adhesive layer g2 by spirally winding a wire or thread 17 in a circumferential direction x of the blanket 10 with applying a tension to the wire or thread 17.

As the wire or thread 17, a cotton thread, a polyester thread and a rayon thread are preferably used taking an ease of operating in case of winding, good drape to the adhesion layers g2, g3 and strength of non-expansion in the axial direction of the wire, that is, tensile strength into consideration.

The diameter of the wire or thread 17 is not specifically limited, but is within the range from 0.1 to 0.5 mm, preferably from 0.15 to 0.45 mm, and more preferably from 0.20 to 0.40 mm. When the diameter of the wire or thread 17 is smaller than the above range, the operation of spirally winding the wire is liable to become difficult. On the other hand, when the diameter exceeds the above range, the action of absorbing the pressure applied onto the plate cylinder by the first compressive layer 12 is prevented and bulging is liable to arise on the surface of the printing blanket 10, resulting in deterioration of the printing quality.

The distance w between adjacent wires in a case of spirally winding the above wire or thread 17 is set not more than 0.5 mm, and preferably not more than 0.25 mm. When the distance w exceeds the above range, since the distance between the wires becomes sparse, the effect obtained by providing the non-expansion layer 13, that is, the effect of preventing excess extension in the radial direction caused by elastic rebounding of the blanket 10 released from the compression force after passing through the nip deformed portion and formation of a so-called standing wave where the surface printing layer is corrugated is liable to be become insufficient.

When the thread 17 is a cotton thread, for example, the tension at the time of spirally winding the thread 17 is within the range from 100 to 800 g, preferably from 200 to 700 g, and more preferably from 300 to 500 g. When the tension is smaller than the above range, the above effect obtained by providing the non-expansion layer 13 becomes insufficient and the pressing force of the printing blanket 10 onto the plate cylinder and paper is lowered. Therefore, blur is liable to arise at the solid portion by deterioration of so-called solid inking property, wherein transfer of ink at the solid portion of the printed image becomes insufficient. On the other hand, when the tension exceeds the above range, excess load is applied on the compressive layer 2 at the time of winding of the wire and setting is liable to arise.

(v) Adhesive Layer g2

The adhesive layer g2, which may be optionally provided between the first compressive layer 12 and the non-expansion layer 13, is formed, for example, by applying the same rubber cement as that for adhesive layer g1 on the first compressive layer 12.

The rubber cement for adhesive layer g2 preferably contains a rubber having excellent compatibility and adhesion to the first compressive layer 12 and non-expansion layer 13 as a main component.

The thickness of the adhesive layer g2 is not specifically limited, but is preferably set within the same range as that of the above adhesive layer g1.

(vi) Second Compressive Layer 14

The second compressive layer 14, which is porous and seamless, is formed directly on the above non-expansion layer 13, or formed on the surface of the non-expansion layer 13 through an adhesive layer g3. That is, the second compressive layer is formed by applying an uncured rubber cement for forming the second compressive layer 14 on the surface of the non-expansion layer 13 or the adhesive layer g3, or winding a sheet made of an uncured compound around them, followed by curing. Regarding the above sheet, the seam portions are molten and integrated in case of curing, thereby to form a seamless state.

As the elastomer constituting the second compressive layer 14, there can be used a synthetic rubber having excellent effect of absorbing vibration and shock load and high damping property to vibration, particularly preferably. Specific examples of the synthetic rubber include the same synthetic rubber as that used in the first compressive layer 12.

The thickness t of the second compressive layer 14 is limited by the total with the thickness of the surface printing layer described hereafter, and the thickness t of the second compressive layer 14 alone is set within the range from 0.05 to 0.45 mm, preferably from 0.1 to 0.4 mm, and more preferably from 0.15 to 0.3 mm. When the thickness t of the second compressive layer 14 exceeds the above range, the reaction force at the time of compression is too lowered and the solid inking property is liable to be deteriorated. On the other hand, when the thickness t of the second compressive layer 14 is smaller than the above range and the thickness of the surface printing layer 15 is small, the adhesion between the printing plate and blanket is lowered and the nip width becomes small. As a result, the halftone dot reproducibility is good but the solid inking property is deteriorated. When the thickness t of the second compressive layer 14 is smaller than the above range and the thickness of the surface printing layer 15 is large, bulging is liable to arise at the nip portion and the nip width becomes large. As a result, the solid inking property is good but the halftone dot reproducibility is deteriorated. That is, it becomes difficult to satisfy both the solid inking property and halftone dot reproducibility at the same time.

The porous structure of the second compressive layer 14 may be either of a closed-cell structure or an open-cell structure, similar to the above first compressive layer 12.

The porosity showing the proportion of the cells in the second compressive layer 14 is set within the range from 10 to 80%, preferably from 20 to 80%, and more preferably from 30 to 70%, independent from the cell structure.

When the porosity of the second compressive layer 14 is smaller than the above range, the volume compressibility becomes poor. Therefore, when the thickness of the surface printing layer is small, the adhesion between the printing plate and blanket is deteriorated and the nip width becomes small with the result that the halftone dot reproducibility is good but the solid inking property is deteriorated. On the other hand, when the porosity of the second compressive layer 14 is smaller than the above range and the thickness of the surface printing layer is large, bulging is liable to arise at the nip portion and the nip width becomes large. As a result, the solid inking property is good but the halftone dot reproducibility is deteriorated. That is, it becomes difficult to satisfy both the solid inking property and halftone dot reproducibility at the same time.

To the contrary, when the porosity exceeds the above range, even if the thickness of the layers outside the non-expansion layer 13 (i.e. adhesive layer g3, second compressive layer 14 and surface printing layer 11) is reduced, the blanket 10 is liable to cause the shear deformation at the time of high-speed printing at not less than 1,100 rpm and slur and double are liable to arise.

To impart the closed-cell structure to the second compressive layer 14, the same method as that used in case of the above first compressive layer 12 may be used. Examples of the foaming agent and hollow fine particles used for providing closed-cells as well as particles used in the leaching method in case of providing open cells include the same one as that described above. The amount of the above foaming agent, the particle diameter and amount of the hollow fine particles, and the particle diameter and amount of the particles for leaching method are appropriately set according to the porosity of the above second compressive layer 14.

The relationship of the porosity between the second compressive layer 14 and first compressive layer 12 is not specifically limited, but the porosity of the second compressive layer 14 is preferably larger than that of the first compressive layer. By setting the porosity of the second compressive layer to the value larger than that of the first compressive layer 12, it becomes possible to preferentially cause deformation of the second compressive layer and to further enhance the adhesion between the plate cylinder at the nip portion and the blanket surface. Accordingly, the solid inking property can be further improved while maintaining the halftone dot reproducibility.

The hardness of the second compressive layer 14 is not specifically limited, but the Shore C-scale (JIS C) is within the range from 30 to 90, preferably from 40 to 80, and more preferably from 50 to 70, in view of the effect of absorbing vibration and shock load.

(vii) Adhesive Layer g3

The adhesive layer g3, which may be optionally provided between the non-expansion layer 13 and second compressive layer 14, is formed, for example, by applying the same rubber cement as that for adhesive layer g2 on the surface of the non-expansion layer 13.

The thickness of the adhesive layer g3 is not specifically limited, but is preferably set within the same range as that of the above adhesive layer g1.

(viii) Surface Printing Layer 15

The surface printing layer is a layer made of an elastomer, which is volume-non-compressive and is seamless, and is formed on the surface of the above second compressive layer 14. That is, the surface printing layer is formed on the surface of the second compressive layer 14 by applying an uncured rubber cement for forming the surface printing layer on the surface of the second compressive layer 14, or winding a sheet made of an uncured compound around it, followed by curing. Regarding the above sheet, the seam portions are molten and integrated in case of curing, thereby to form a seamless state.

As the elastomer constituting the surface printing layer 15, there can be used a synthetic rubber having excellent effect of absorbing vibration and shock load, high damping property to vibration and excellent oil resistance, particularly preferably. Specific examples includes the same synthetic rubber as that described as the elastomer constituting the above first compressive layer 12. It is also possible to use a polysulfide rubber (T) and hydrogenated NBR.

The thickness of the surface printing layer 15 is set within the range from 0.05 to 0.4 mm, preferably from 0.1 to 0.35 mm, and more preferably from 0.15 to 0.30 mm. When the thickness of the surface printing layer is smaller than the above range, the reaction force at the time of compression is lowered and the halftone dot or solid inking property is liable to be deteriorated. On the other hand, when the thickness exceeds the above range, since the effect of inhibiting bulging and extension in the circumferential direction of the surface printing layer associated with bulging becomes insufficient, dot gain and deformation of the halftone dot (e.g. double, slur, etc.) are liable to arise and the halftone dot reproducibility is liable to be deteriorated.

(ix) Total of Thickness of Surface Printing Layer 15 and That of Second Compressive Layer 14

The total of the thickness of the surface printing layer 15 and that of the second compressive layer 14 is set within the range from 0.1 to 0.5 mm, preferably from 0.15 to 0.45 mm, and more preferably from 0.2 to 0.4 mm. When the total of the thickness of both layers exceeds the above range, the effect of inhibiting bulging and the effect of inhibiting extension in the circumferential direction x of the surface printing layer 15 become insufficient and deformation of the halftone dot (e.g. double, slur, etc.) is liable to arise. On the other hand, when the total of the thickness of both layers is smaller than the above range, the adhesion between the surface of the blanket 10 and plate cylinder 40 is deteriorated and the nip width 41 becomes small. As a result, the solid inking property is liable to be deteriorated.

Furthermore, an adhesive layer may be provided between the surface printing layer 15 and second compressive layer 14. In this case, the total of the thickness of the surface printing layer 15, that of the second compressive layer 14 and that of the adhesive layer must be set within the above range.

The above respective layers constituting the printing blanket 10 of the present invention may be laminated in an order from the layer close to the sleeve 11 to the outer layer. The respective layers may be cured every time one of the layers is formed, and also, a plurality of the layers may be simultaneously cured. When the first or second compressive layer has an open-cell structure, however, the compressive layer is preferably cured before forming a layer to be laminated on the surface, followed by extraction of the particles because the particles for leaching method may be extracted.

Figure 3:
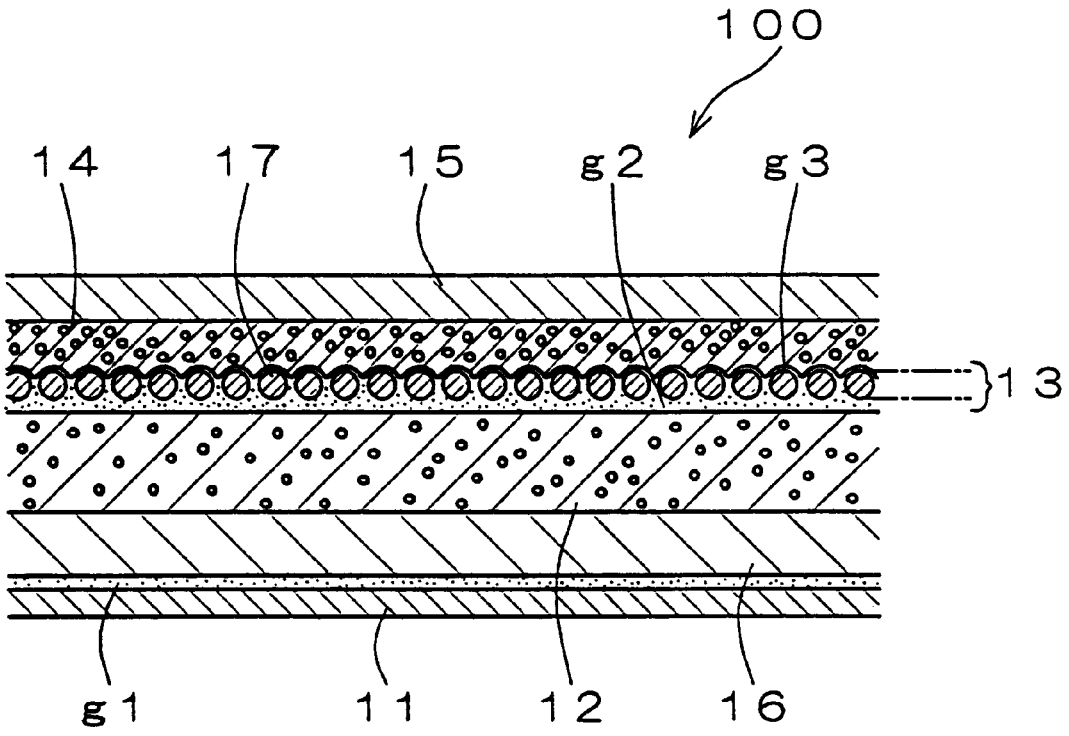
FIG. 3 is a sectional view showing another embodiment of a printing blanket of the present invention.

The construction of the printing blanket of the present invention is not limited to the embodiments of FIG. 1 and FIG. 2, described in detail hereinabove, and modifications may be made without changing the gist of the present invention. For example, like a printing blanket 100 shown in FIG. 3, a base layer 16 may be provided between the sleeve 11 and first compressive layer 12.

As the rubber constituting the base layer 16, there can be used a synthetic rubber having excellent effect of absorbing vibration and shock load and high damping property to vibration, particularly preferably. The synthetic rubber is preferably superior in oil resistance taking the resistance to printing ink into consideration. Specific examples of the synthetic rubber include acrylonitrile-butadiene copolymer rubber (NBR), chloroprene rubber (CR), urethane rubber (U) and the like, but are not limited thereto.

By forming the above base layer 16 on the sleeve 11 directly or through the adhesive layer g1, there can be obtained an effect of inhibiting dynamic fatigue and setting caused by heat in use of the printing blanket 10 because the strength of the layer 16 is larger than that of the first compressive layer 12. If the layers outside the first compressive layer 12 and the layer 12 are peeled off by grinding and the like, the sleeve 11 is protected by the action of the base layer 16. Accordingly, there is an advantage that the operation of recovering and reusing the sleeve 11 is facilitated.

The thickness of the above base layer 16 is not specifically limited, but is within the range from 0.2 to 10.0 mm, preferably from 0.4 to 5.0 mm, and more preferably from 0.8 to 2.0 mm. When the thickness of the base layer 16 is less than the above range, the above effect due to the layer 16 is not obtained sufficiently. On the other hand, when the thickness exceeds the above range, extension in the circumferential direction of the surface printing layer becomes large in the case of bulging and deformation of the halftone dot is liable to be arise.

When the first compressive layer 12 is formed on the surface of the base layer 16, an adhesion layer g4, which is formed in the same manner as that in the case of the adhesive layer g2, may be provided on the surface of the base layer 16.

According to the printing blanket of the present invention, a high-quality print can be obtained even at high-speed printing by the action of two compressive layers provided inside a surface printing layer through a non-expansion layer. Since piling is inhibited at the time of high-speed printing, printing can be performed in high productivity.

EXAMPLES

The following Examples and Comparative Examples further illustrate the present invention in detail.

Examples 1 to 7 and Comparative Examples 1 to 5

In the same manner as shown in the following items (a) to (d), a printing blanket having a layer construction shown in FIG. 1 was produced.

(a) Production of First Compressive Layer 12

A sleeve 11 made of nickel (inner diameter: 169.5 mm, length: 910 mm, thickness: 0.125 mm, manufactured by STOKES CO.) was fit over a curing mandrel having the same sleeve detachable mechanism due to pressure gas as that of a blanket cylinder.

An adhesive (manufactured by LORD CHEMICAL CO. under the trade name of "Chemlock 205") was applied on the outer peripheral surface of the sleeve 11 and dried and, furthermore, an adhesive manufactured by the same company under the trade name of "Chemlock 252X" was applied thereon and dried to form an adhesive layer g1 of a two-layer structure (total thickness: 0.05 mm).

Then, a rubber cement made of the following components was applied on the surface of the adhesive layer g1 by a rotary rubber spreader utilizing a doctor roll (manufactured by SUMITOMO RUBBER INDUSTRIES, LTD.) and air-dried for 12 hours. Furthermore, the surface was wrapped by winding a cotton knitted sheet (width: 1,000 mm) in a circumferential direction, put in a curing reactor (manufactured by KANSAI ROLL CO., LTD., 1,000 mm×2,000 mm) in this state, and then cured under the conditions at 140° C. under 3 kg/cm$^2$ for 90 minutes.

[Rubber cement for first compressive layer]

| (Components) | (Parts by weight) |
|---|---|
| Uncured NBR | 100 |
| Furnace Black (filler) | 30 |
| Clay filler | 40 |
| Stearic acid (plasticizer) | 1 |
| Phenolic antioxidant | 1 |
| Powdered sulfur (curing agent) | 2.5 |
| Sulfenamide curing accelerator | 1.5 |
| Thiuram curing accelerator | 1 |
| Zinc oxide (curing accelerator) | 5 |
| Hollow fine particles (*1) | 10 |
| Toluene (solvent) | 100 |

*1: Those with a shell body made of a copolymer of vinylidene chloride and acrylonitrile After curing, the surface was polished by a cylindrical grinder (manufactured by TOYODA MACHINARY CORP.) to form a first compressive layer 12 having a thickness of 0.5 mm (dimensional tolerance: within ±0.01 mm). The first compressive layer 12 had a Shore C-scale hardness (JIS C) of 80 and a closed-cell structure, and its porosity was 30%.

(b) Production of Non-Expansion Layer 13

A rubber cement made of the following components was applied on the surface of the above first compressive layer 12 by the aforementioned rotary rubber spreader and air-dried for 30 minutes to form an adhesive layer g2 (thickness: 0.05 mm).

[Rubber cement for adhesive layer]

| (Components) | (Parts by weight) |
|---|---|
| Uncured NBR | 90 |
| Uncured CR | 10 |
| Clay filler | 70 |
| Stearic acid (plasticizer) | 1 |
| Phenolic antioxidant | 1 |
| Powdered sulfur (curing agent) | 1 |
| Guanidine curing accelerator | 1 |
| Sulfenamide curing accelerator | 1 |
| Zinc oxide (curing accelerator) | 5 |
| Thermosetting resin (adhesive) | 5 |
| Magnesium oxide | 3 |
| Toluene (solvent) | 100 |

Then, a wire 17 (cotton thread having a diameter of 0.4 mm) was wound spirally around the surface of the adhesive layer g2 with applying a tension of ±50 gf. A cylindrical molder (manufactured by SUMITOMO RUBBER INDUSTRIES, LTD.) was used for winding the wire 17, and the distance between the adjacent wires was adjusted to 0.25 mm or less.

The surface of the wire 17 wound around the adhesive layer g2 was wrapped by winding a cotton knitted sheet (width: 1,000 mm) in a circumferential direction, put in the aforementioned curing reactor in this state and then cured under the conditions at 140° C. under 3 kg/cm$^2$ for 90 minutes to form a non-expansion layer 13 having a thickness of 0.4 mm.

(c) Production of Second Compressive Layer 14

The same rubber cement for adhesive layer as that used in the aforementioned adhesive layer g2 was applied on the surface of the above non-expansion layer 13 and dried to form an adhesive layer g3 (thickness: 0.05 mm).

Then, the same rubber cement as that used for forming the above first compressive layer 12 was applied on the surface of the adhesive layer g3 by the aforementioned rotary rubber spreader and air-dried for 12 hours. Furthermore, the surface was wrapped by winding a cotton knitted sheet (width: 1,000 mm) in a circumferential direction, put in the aforementioned curing reactor in this state, and then cured under the conditions at 140° C. under 3 kg/cm$^2$ for 90 minutes.

After curing, the surface was polished by the aforementioned cylindrical grinder to form a second compressive layer 14 having the thickness (dimensional tolerance: within ±0.01 mm) shown in Table 1 below. The second compressive layer 14 had a Shore C-scale hardness (JIS C) of 80 and a closed-cell structure, and its porosity was 50%.

(d) Production of Surface Printing Layer 15

The rubber cement made of the following respective components was applied on the surface of the above second compressive layer 14 by the aforementioned rotary rubber spreader and air-dried for 12 hours. Furthermore, the surface was wrapped by winding a cotton knitted sheet (width: 1,000 mm) in a circumferential direction, put in the aforementioned curing reactor in this state, and then cured under the conditions at 140° C. under 3 kg/cm$^2$ for 90 minutes.

[Rubber cement for surface printing layer]

| (Components) | (Parts by weight) |
|---|---|
| Uncured NBR | 100 |
| Clay filler | 40 |
| Stearic acid (plasticizer) | 1 |
| Process oil (plasticizer) | 5 |
| Powdered sulfur (curing agent) | 0.5 |
| Thiuram curing accelerator | 1 |
| Zinc oxide (curing accelerator) | 5 |
| Thermosetting resin (adhesive) | 3 |
| 6-Ethoxy-1,2-dihydro-2,2,4-trimethylquinoline (a quinoline compound) | 1 |
| Toluene (solvent) | 100 |

After curing, the surface was polished by the aforementioned cylindrical grinder to form a surface printing layer 15 having the thickness shown in Table 1 below (dimensional tolerance: within ±0.01 mm). The surface printing layer 15 had a Shore A-scale hardness (JIS A) of 65, and ten-point average roughness Rz of the surface was from 3 to 5 $\mu$m.

As described above, a printing blanket 10 having the layer structure shown in Table 1 was obtained.

With respect to the printing blankets 10 obtained in the above respective Examples and Comparative Examples, the thickness (mm) and porosity (%) of the first compressive layer 12, the thickness (b) (mm) and porosity (%) of the second compressive layer 14, the thickness (a) of the surface printing layer, and the total (mm) of the thickness (a) of the surface printing layer 15 and the thickness (b) of the second compressive layer 14 are shown in Table 1, respectively.

Further, the porosity of the compressive layer is calculated as an area ratio by observing samples using a microscope.

TABLE 1

| | Surface printing layer 15 | Second compressive layer 14 | | First compressive layer 12 | | Total of |
|---|---|---|---|---|---|---|
| | Thickness (a) | Thickness (b) | Porosity | Thickness | Porosity | thickness (a) + (b) |
| Comp. Ex. 1 | 0.07 | 0.03 | 50 | 0.5 | 30 | 0.1 |
| Example 1 | 0.05 | 0.05 | 50 | 0.5 | 30 | 0.1 |
| Comp. Ex. 2 | 0.03 | 0.07 | 50 | 0.5 | 30 | 0.1 |
| Example 2 | 0.2 | 0.1 | 50 | 0.5 | 30 | 0.3 |
| Example 3 | 0.15 | 0.15 | 50 | 0.5 | 30 | 0.3 |
| Example 4 | 0.1 | 0.2 | 50 | 0.5 | 30 | 0.3 |
| Comp. Ex. 3 | 0.47 | 0.03 | 50 | 0.5 | 30 | 0.5 |
| Example 5 | 0.45 | 0.05 | 50 | 0.5 | 30 | 0.5 |
| Example 6 | 0.25 | 0.25 | 50 | 0.5 | 30 | 0.5 |
| Example 7 | 0.05 | 0.45 | 50 | 0.5 | 30 | 0.5 |
| Comp. Ex. 4 | 0.03 | 0.47 | 50 | 0.5 | 30 | 0.5 |
| Comp. Ex. 5 | 0.3 | 0.3 | 50 | 0.5 | 30 | 0.6 |

Unit for "Thickness" and "Total of thickness" is mm.
Unit for "Porosity" is %.

The printing blankets of the above respective Examples and Comparative Examples were subjected to a printing test, and their halftone dot reproducibility and solid inking property were evaluated.

Printing Test

Each of the printing blankets 10 obtained in the above Examples and Comparative Examples was fit to a high-speed web offset printing press ("Gapless Press", manufactured by MITSUBISHI HEAVY INDUSTRIES CO., LTD.) and solid printing (3 mm×3 mm) was performed on the surface of a wood free paper by using black oil-based ink. The printing rate (revolution number of blanket cylinder) was set to 1,300 rpm.

Evaluation of Halftone Dot Reproducibility

A longitudinal diameter (length of halftone dot in a printing direction, i.e. circumferential direction x of blanket) and a lateral diameter (length of halftone dot in a width direction of a printing paper) of a halftone dot formed by printing on the wood free paper were observed by a microscope, and then an area ratio [provided that the area of the halftone dot (perfect round shape) is 1] and a ratio (longitudinal diameter/lateral diameter) of the longitudinal diameter to the lateral diameter were calculated.

The degree of dot gain can be evaluated by the above "area ratio" and, whereas, the degree of slur and double can be evaluated by the "length ratio". When the "area ratio" is within the range from 0.9 to 1.1 and the "length ratio" is within the range from 1.0 to 1.1, it can be said that the halftone dot reproducibility is good.

When the halftone dot has a perfect round shape (the halftone dot reproducibility is the best), the area ratio is 1 and the length ratio is 1. When the halftone dot becomes smaller (becomes thin), the area ratio is smaller than 1 and the length ratio is 1. On the other hand, when the halftone dot becomes larger (becomes thick), the area ratio is larger than 1 and the length ratio is 1. The halftone dot becomes thin or thick when slur and double do not arise. When slur or double arises, the area ratio is larger than 1 and the length ratio is larger than 1.

Brightness Standard Deviation

The halftone dot formed by printing on the wood free paper was observed by using an image processing device (Model No. "LA555") manufactured by PIAS CO., LTD. and the brightness standard deviation was determined. The solid inking property of each printing blanket were evaluated based on the knowledge that the smaller the brightness standard deviation, the better the solid inking property. When the brightness standard deviation is not more than 19.5, it can be said that the solid inking property is good.

The above results are shown in Table 2.

TABLE 2

| | Halftone dot reproducibility | | Inking property brightness | |
|---|---|---|---|---|
| | Area ratio | Length ratio | standard deviation | Notes |
| Comp. Ex. 1 | 0.91 | 1.0 | 21 | Bad inking property |
| Example 1 | 0.95 | 1.0 | 19 | — |
| Comp. Ex. 2 | 0.92 | 1.0 | 21 | Bad inking property |
| Example 2 | 1.03 | 1.0 | 16 | — |
| Example 3 | 1.02 | 1.0 | 14 | — |
| Example 4 | 1.01 | 1.0 | 16 | — |
| Comp. Ex. 3 | 1.18 | 1.12 | 17 | Bad halftone reproducibility |
| Example 5 | 1.08 | 1.08 | 15 | — |
| Example 6 | 1.08 | 1.06 | 14 | — |
| Example 7 | 1.07 | 1.06 | 17 | — |
| Comp. Ex. 4 | 1.06 | 1.05 | 20 | Bad inking property |
| Comp. Ex. 5 | 1.13 | 1.12 | 15 | Bad halftone reproducibility |

As is apparent from Table 1 and Table 2, when the thickness of the surface printing layer 15 and that of the second compressive layer 14 are adjusted within the range from 0.05 to 0.45 mm, respectively, and the total of the thickness of the surface printing layer 15 and that of the second compressive layer 14 is adjusted within the range from 0.1 to 0.5 mm, both results of the halftone dot reproducibility and solid inking property were good.

Examples 8 to 11 and Comparative Examples 6 and 7

According to the same manner as that described in Example 3 except that the amount of the hollow fine particles contained in the rubber cement for second compressive layer 14 was changed and the porosity (%) in the layer 14 was set to the value shown in Table 3, a printing blanket 10 having the layer construction shown in FIG. 1 was obtained, respectively.

Examples 12 to 16

According to the same manner as that described in Examples 8, 9, 3, 10 and 11, respectively, except that the amount of the hollow fine particles contained in the rubber cement for first compressive layer 12 was changed and the porosity (%) in the layer 12 was changed to 50%, a printing blanket 10 having the layer construction shown in FIG. 1 was obtained, respectively.

Examples 17 and 18 and Comparative Examples 8 and 9

According to the same manner as that described in. Example 3 except that the thickness of the first compressive layer 12 was set to the value shown in Table 3, a printing blanket 10 having the layer construction shown in FIG. 1 was obtained, respectively.

With respect to the printing blankets 10 obtained in Examples 8 to 18 and Comparative Examples 6 to 9, the thickness (mm) and porosity (%) of the first compressive layer 12, the thickness (b) (mm) and porosity (%) of the second compressive layer 14, the thickness (a) of the surface printing layer, and the total (mm) of the thickness (a) of the surface printing layer 15 and the thickness (b) of the second compressive layer 14 are shown in Table 3, respectively.

The calculation method of the porosity is the same as that mentioned above.

TABLE 3

| | Surface printing layer 15 | Second compressive layer 14 | | First compressive layer 12 | | Total of |
|---|---|---|---|---|---|---|
| | Thickness (a) | Thickness (b) | Porosity | Thickness | Porosity | thickness (a) + (b) |
| Comp. Ex. 6 | 0.15 | 0.15 | 5 | 0.5 | 30 | 0.3 |
| Example 8 | 0.15 | 0.15 | 10 | 0.5 | 30 | 0.3 |
| Example 9 | 0.15 | 0.15 | 30 | 0.5 | 30 | 0.3 |
| Example 3 | 0.15 | 0.15 | 50 | 0.5 | 30 | 0.3 |
| Example 10 | 0.15 | 0.15 | 70 | 0.5 | 30 | 0.3 |
| Example 11 | 0.15 | 0.15 | 80 | 0.5 | 30 | 0.3 |
| Comp. Ex. 7 | 0.15 | 0.15 | 85 | 0.5 | 30 | 0.3 |
| Example 12 | 0.15 | 0.15 | 10 | 0.5 | 50 | 0.3 |
| Example 13 | 0.15 | 0.15 | 30 | 0.5 | 50 | 0.3 |
| Example 14 | 0.15 | 0.15 | 50 | 0.5 | 50 | 0.3 |
| Example 15 | 0.15 | 0.15 | 70 | 0.5 | 50 | 0.3 |
| Example 16 | 0.15 | 0.15 | 80 | 0.5 | 50 | 0.3 |
| Comp. Ex. 8 | 0.15 | 0.15 | 50 | 0.05 | 30 | 0.3 |
| Example 17 | 0.15 | 0.15 | 50 | 0.1 | 30 | 0.3 |
| Example 3 | 0.15 | 0.15 | 50 | 0.5 | 30 | 0.3 |
| Example 18 | 0.15 | 0.15 | 50 | 2.0 | 30 | 0.3 |
| Comp. Ex. 9 | 0.15 | 0.15 | 50 | 2.2 | 30 | 0.3 |

Unit for "Thickness" and "Total of thickness" is mm.
Unit for "Porosity" is %.

The printing blankets of Examples 8 to 18 and Comparative Examples 6 to 9 were subjected to a printing test according to the same manner as that described above, and their halftone dot reproducibility and solid inking property were evaluated, respectively.

The above results are shown in Table 4.

TABLE 4

| | Halftone dot reproducibility | | Inking property brightness | |
|---|---|---|---|---|
| | Area ratio | Length ratio | standard deviation | Notes |
| Comp. Ex. 6 | 1.08 | 1.08 | 19.8 | Bad inking property |
| Example 8 | 1.06 | 1.05 | 19.2 | — |
| Example 9 | 1.04 | 1.03 | 16 | — |
| Example 3 | 1.02 | 1.0 | 14 | — |
| Example 10 | 1.06 | 1.06 | 14 | — |
| Example 11 | 1.08 | 1.08 | 14 | — |
| Comp. Ex. 7 | 1.11 | 1.11 | 14 | Bad halftone reproducibility |
| Example 12 | 1.07 | 1.07 | 19 | — |
| Example 13 | 1.04 | 1.04 | 18 | — |
| Example 14 | 1.05 | 1.05 | 16 | — |
| Example 15 | 1.07 | 1.06 | 14 | — |
| Example 16 | 1.08 | 1.08 | 14 | — |
| Comp. Ex. 8 | 1.15 | 1.15 | 12 | Bad halftone reproducibility |
| Example 17 | 1.08 | 1.09 | 13 | — |
| Example 3 | 1.02 | 1.0 | 14 | — |
| Example 18 | 0.94 | 1.0 | 19 | — |
| Comp. Ex. 9 | 0.93 | 1.0 | 20 | Bad inking property |

As is apparent from Table 3 and Table 4, when the porosity of the second compressive layer 14 is adjusted within the range from 10 to 80% (Examples 3, 8–11), the porosity of the second compressive layer 14 is adjusted to the value larger than that of the first compressive layer 12 (Examples 12–16), or the thickness of the first compressive layer 12 is adjusted within the range from 0.1 to 2.0 mm (Examples 3, 17 and 18), the halftone dot reproducibility and solid inking property were good in all the cases.

Comparative Examples 10 to 12

According to the same manner as that described in "production of first compressive layer 12" in Examples 1 to 7, a rubber cement for adhesive layer and a rubber cement for compressive layer were applied on the surface of a sleeve 11 and, after forming an adhesive layer g1 and a compressive layer 22 (thickness: 0.5 mm) in this order, an adhesive layer g2 and a non-expansion layer 23 (thickness: 0.4 mm) were formed in this order on the surface of the above compressive layer 22 according to the same manner as that described in "production of non-expansion layer 13" in Examples 1 to 7.

Figure 4:
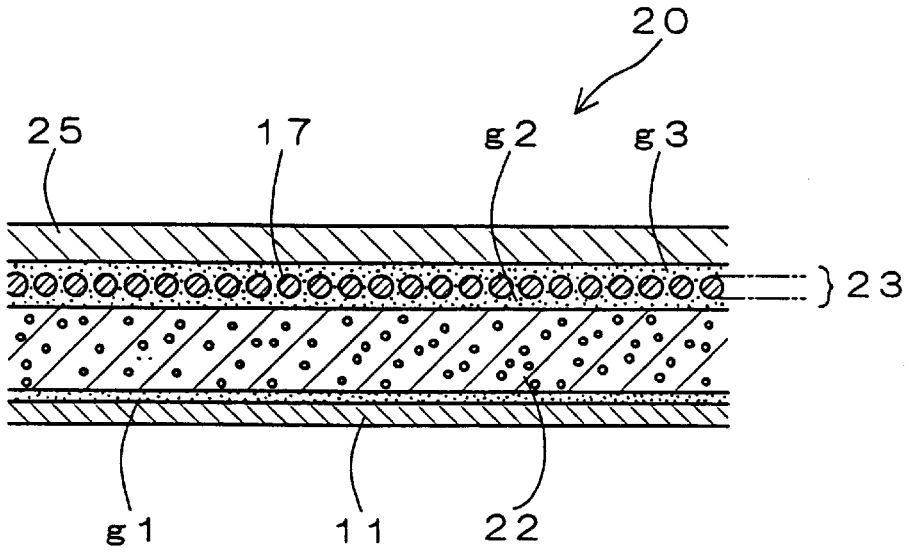
FIG. 4 is a sectional view showing one embodiment of a printing blanket of the prior art.
Figure 5:
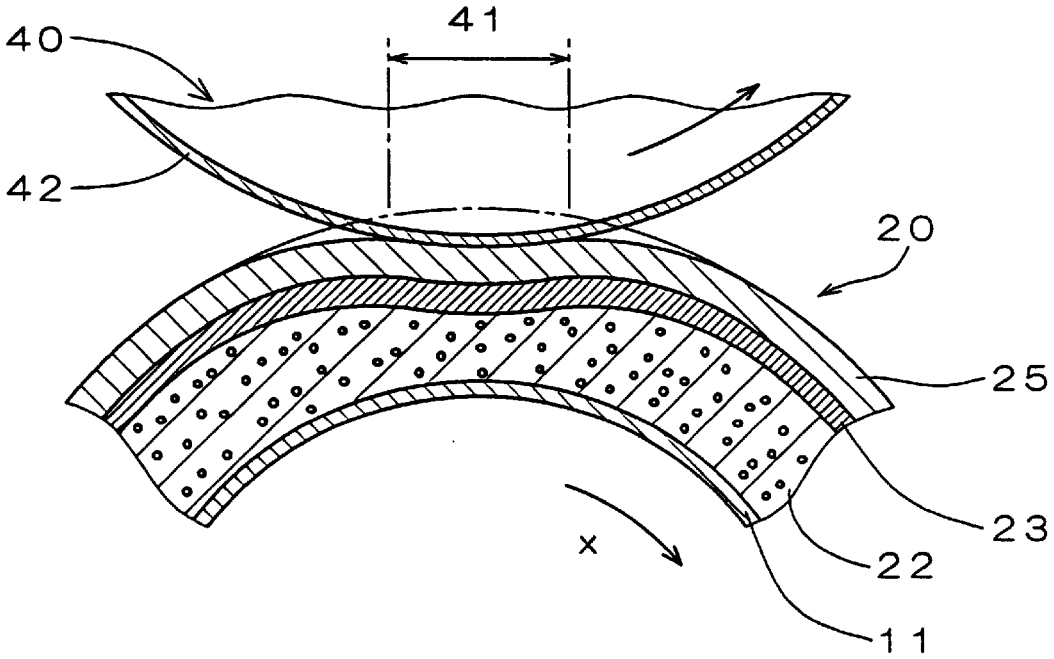
FIG. 5 is a sectional view showing a state of a nip portion when a surface printing layer is thin in the printing blanket shown in FIG. 4.
Figure 6:
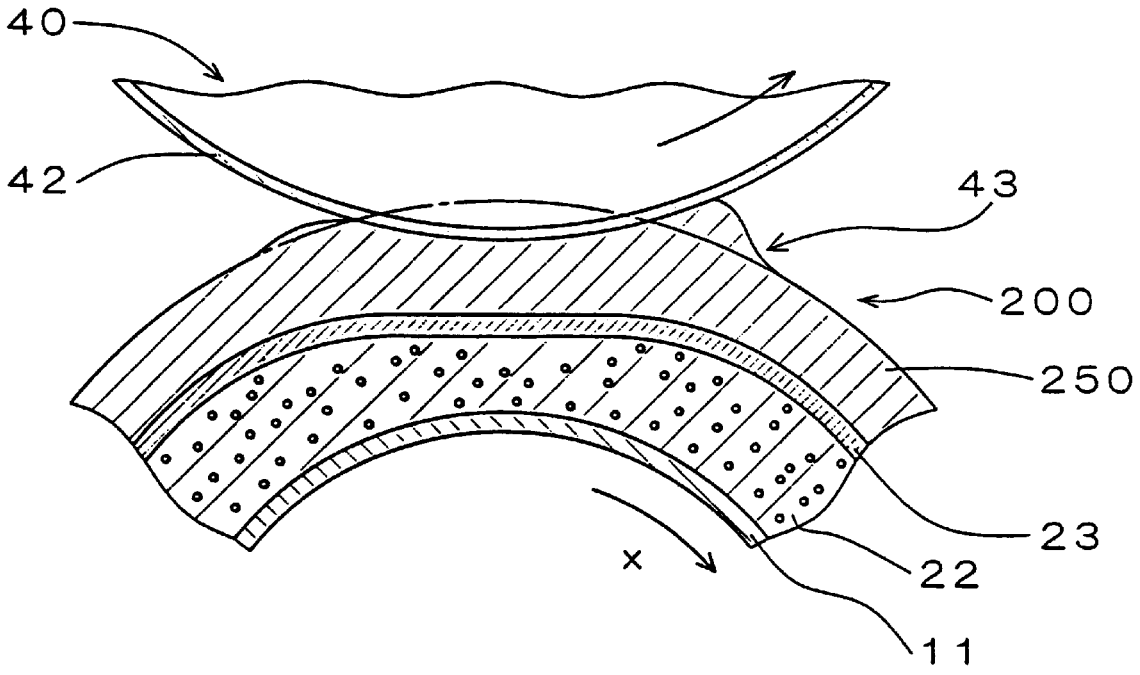
FIG. 6 is a sectional view showing a state of a nip portion when a surface printing layer is thick in the printing blanket shown in FIG. 4.

Then, the same rubber cement for adhesive layer as that used in the above adhesive layer g2 was applied on the surface of the above non-expansion layer 23 to form an adhesive layer g3 and, furthermore, a surface printing layer 25 was formed on the surface of the adhesive layer g3 according to the same manner as that described in "production of surface printing layer 15" in Examples 1 to 7, thereby obtaining a printing blanket 20 having the layer construction shown in FIG. 4, respectively. The thickness of the surface printing layer 25 was set to the value shown in Table 5.

TABLE 5

| | Surface printing layer 25 | Compressive layer 22 | |
|---|---|---|---|
| | Thickness (mm) | Thickness (mm) | Porosity (%) |
| Comp.Ex.10 | 0.15 | 0.5 | 30 |
| Comp.Ex.11 | 0.3 | 0.5 | 30 |
| Comp.Ex.12 | 0.5 | 0.5 | 30 |

The printing blankets of Comparative Examples 10 to 12 were subjected to the above printing test at the printing rate of 1,000 rpm, in addition to 1,300 rpm, and their halftone dot reproducibility and solid inking property were evaluated. The above results are shown in Table 6.

TABLE 6

| | Halftone dot reproducibility | | Inking property | |
|---|---|---|---|---|
| | Area ratio | Length ratio | brightness standard deviation | Notes |
| Comp. Ex. 10 | | | | |
| 1,000 rpm | 0.92 | 1.0 | 19 | — |
| 1,300 rpm | 0.93 | 1.0 | 21 | Bad inking property |
| Comp. Ex. 11 | | | | |
| 1,000 rpm | 1.01 | 1.0 | 17 | — |
| 1,300 rpm | 1.09 | 1.09 | 20 | Bad inking property |
| Comp. Ex. 12 | | | | |
| 1,000 rpm | 1.09 | 1.1 | 15 | — |
| 1,300 rpm | 1.20 | 1.15 | 19 | Bad halftone reproducibility |

As is apparent from Table 6, both of the halftone dot reproducibility and solid inking property of the blankets of Comparative Examples 10 to 12 were good when the printing rate is 1,000 rpm. However, the halftone dot reproducibility or solid inking property was inferior at the time of high-speed printing at 1,300 rpm.

Comparative Examples 13 to 15

According to the same manner as that described in "production of non-expansion layer 13" in Examples 1 to 7, an adhesive layer g2 and a non-expansion layer 33 (thickness: 0.4 mm) were formed in this order on the surface of a sleeve 11.

Then, the same rubber cement for adhesive layer as that used in the above adhesive layer g2 was applied on the surface of the above non-expansion layer 33 to form an adhesive layer g3, and then a rubber cement for compressive layer was applied according to the same manner as that described in "production of first compressive layer 12" to form a compressive layer 32.

Figure 7:
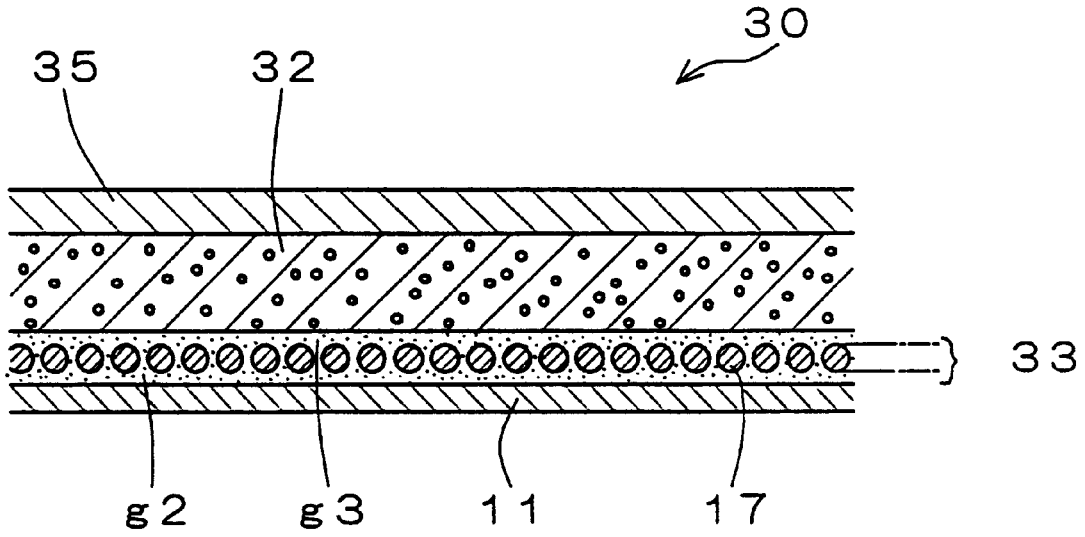
FIG. 7 is a sectional view showing another embodiment of a printing blanket of the prior art.

Furthermore, a surface printing layer 35 (thickness: 0.2 mm) was formed on the surface of the above compressive layer 32 according to the same manner as that described in "production of surface printing layer 15" in Examples 1 to 7, thereby obtaining a printing blanket 30 having the layer construction shown in FIG. 7, respectively. The thickness of the compressive layer 32 was set to the value shown in Table 7.

TABLE 7

| | Surface printing layer 35 | Compressive layer 32 | |
|---|---|---|---|
| | Thickness (mm) | Thickness (mm) | Porosity (%) |
| Comp.Ex.13 | 0.2 | 0.1 | 30 |
| Comp.Ex.14 | 0.2 | 0.3 | 30 |
| Comp.Ex.15 | 0.2 | 0.5 | 30 |

According to the same manner as that described above except that the printing blankets of comparative

TABLE 8

| | Halftone dot reproducibility | | Inking property | |
|---|---|---|---|---|
| | Area ratio | Length ratio | brightness standard deviation | Notes |
| Comp. Ex. 13 | | | | |
| 1,000 rpm | 1.09 | 1.08 | 13.0 | — |
| 1,300 rpm | 1.15 | 1.15 | 13.0 | Bad halftone reproducibility |
| Comp. Ex. 14 | | | | |
| 1,000 rpm | 1.03 | 1.05 | 13.5 | — |
| 1,300 rpm | 1.16 | 1.18 | 13.5 | Bad halftone reproducibility |
| Comp. Ex. 15 | | | | |
| 1,000 rpm | 1.07 | 1.08 | 14.5 | — |
| 1,300 rpm | 1.22 | 1.27 | 14.5 | Bad halftone reproducibility |

As is apparent from Table 8, both of the halftone dot reproducibility and solid inking property of the blankets of Comparative Examples 13 to 15 were good when the printing rate is 1,000 rpm, and the solid inking property particularly was superior to Comparative Examples 10 to 12. However, the halftone dot reproducibility was considerably inferior at the time of high-speed printing at 1,300 rpm.

Comparative Example 16

According to the same manner as that described in "production of first compressive layer 12" in Examples 1 to 7, a rubber cement for adhesive layer and a rubber cement for compressive layer were applied on the surface of a sleeve 11 and, after forming an adhesive layer g1 and a compressive layer 22 (thickness: 0.5 mm) in this order, an adhesive layer g2 and a non-expansion layer 23 (thickness: 0.4 mm) were formed in this order on the surface of the above compressive layer 22 according to the same manner as that described in "production of non-expansion layer 13" in Examples 1 to 7.

Then, the same rubber cement for adhesive layer as that used in the above adhesive layer g2 was applied on the surface of the above non-expansion layer 23 to form an adhesive layer g3. Furthermore, the following rubber cement for surface printing layer was applied on the surface of the adhesive layer g3 according to the same manner as that described in "production of surface printing layer 15" in Examples 1 to 7, dried and then cured to form a surface printing layer 25 (thickness: 0.3 mm), thereby obtaining a printing blanket 20 having the layer construction shown in FIG. 4.

[Rubber cement for surface printing layer]

| (Components) | (Parts by weight) |
|---|---|
| Uncured NBR | 100 |
| Clay filler | 40 |
| Stearic acid (plasticizer) | 1 |
| Process oil (plasticizer) | 5 |
| Powdered sulfur (curing agent) | 0.5 |
| Thiuram curing accelerator | 1 |
| Zinc oxide (curing accelerator) | 5 |
| Thermosetting resin (adhesive) | 3 |
| 6-Ethoxy-1,2-dihydro-2,2,4-trimethylquinoline (a quinoline compound) | 1 |
| Hollow fine particles(*1) | 5 |
| Toluene (solvent) | 100 |

(*1)Those with a shell body made of a copolymer of vinylidene chloride and acrylonitrile The surface printing layer 25 in the printing blanket 20 obtained in Comparative Example 16 had a spongy layer having a closed-cell structure. The surface printing layer 25 had a hardness (Shore C-scale hardness) of 50 and a ten-point average roughness Rz of the surface was from 9 to 11 μm, and the compressive layer 22 had a hardness (Shore C-scale hardness) of 80.

The printing blanket of Comparative Example 16 was subjected to a printing test according to the same manner as that described above, and their halftone dot reproducibility and solid inking property were evaluated. As a result, the "brightness standard deviation" was 19.0 and the solid inking property was within the practically acceptable range. Among indexes showing the halftone dot reproducibility, the "area ratio" was 1.0 and was within the practically acceptable range, but the perimeter of the halftone dot obtained by printing when the diameter of the halftone dot (complete round shape) of a printing plate was 1 was 6. This perimeter is very large in comparison with a normal case where the perimeter of the halftone dot is preferably within the range from 2.9 to 3.3. Such a large value of the perimeter is derived from formation of serration in the peripheral shape of the halftone dot (irregularity like saw blade). It is considered that this is caused by the fact that the surface printing layer is spongy. The value of the perimeter of the halftone dot is measured by observing the halftone dot formed by printing on the wood free paper, using a microscope.

Furthermore, the printing blanket 20 of Comparative Example 16 was subjected to the following test, and evaluation of piling was performed.

Evaluation of Piling

Washing of the blanket was performed by spraying a wash liquid (manufactured by DAINIPPON INK AND CHEMICALS, INCORPORATED under the trade name of "Daiclean") on the surface of the blanket and wiping the blanket surface with a belt of a nonwoven fabric. After washing, the blanket was subjected to an actual test to determine the revolution number of the blanket at the time when the solid inking property was deteriorated by piling and the bright standard deviation increased by 0.5. The larger this revolution number, the more difficult for piling to arises. The revolution number of the blanket is preferably not less than 70,000 in view of the printing productivity.

As a result, it has been found that, since the surface printing layer of the blanket of Comparative Example 16 is spongy and the surface is rough, the blanket must be cleaned when the revolution number of the blanket reaches 30,000. That is, the printing blanket of Comparative Example 16 has low printing productivity and, therefore, it is unsuitable for practical use. To the contrary, in case of the printing blankets obtained in the above Examples, the revolution number of the blanket at the time when the brightness standard deviation value increased by 0.5 showed a value of not less than 70,000.

What is claimed is:

1. A printing blanket comprising:

(1) a first compressive layer which is porous and seamless, (2) a non-expansion layer formed by spirally winding a thread in a circumferential direction of the blanket so that a distance between adjacent threads is not more than 0.5 mm, (3) a second compressive layer which is porous and seamless, (4) a surface printing layer which is seamless and non-compressive, and a cylindrical sleeve to be fit over a blanket cylinder, wherein said layers are laminated in this order with no other structural layers between said second compressive layer and said surface printing layer on an outer peripheral surface of said cylindrical sleeve directly or through a seamless adhesive layer, and the thickness of the second compressive layer is from 0.05 to 0.45 mm, the thickness of the surface printing layer is from 0.05 to 0.45 mm, the total of the thickness of the surface printing layer and that of the second compressive layer is from 0.1 to 0.5 mm, and the thickness of the first compressive layer is from 0.1 to 2.0 mm.

2. The printing blanket according to claim 1, wherein the porosity of the second compressive layer is from 10 to 80%.

3. The printing blanket according to claim 2, wherein the porosity of the second compressive layer is higher than that of the first compressive layer.

4. The printing blanket according to claim 2, wherein a base layer, which is seamless and non-compressive, is provided between the sleeve and the first compressive layer directly or through a seamless adhesive layer.

5. The printing blanket according to claim 1, wherein the porosity of the second compressive layer is higher than that of the first compressive layer.

6. The printing blanket according to claim 1, wherein a base layer, which is seamless and non-compressive, is provided between the sleeve and the first compressive layer directly or through a seamless adhesive layer.

* * * * *